US006336893B1

(12) United States Patent
Chen

(10) Patent No.: US 6,336,893 B1
(45) Date of Patent: Jan. 8, 2002

(54) PROTECTION DEVICE FOR TRAMPOLINE

(75) Inventor: Jimmy Ching Chen, Rosemead, CA (US)

(73) Assignee: Sportspower Limited, Kowloon (HK)

( * ) Notice: Subject to any disclaimer, the term of this patent is extended or adjusted under 35 U.S.C. 154(b) by 0 days.

(21) Appl. No.: 09/547,851

(22) Filed: Apr. 12, 2000

(51) Int. Cl.[7] ..... A63B 5/11
(52) U.S. Cl. ..... 482/29; 482/27
(58) Field of Search ..... 482/27–29

(56) References Cited

U.S. PATENT DOCUMENTS 5,941,798 A * 8/1999 Coan et al. ..... 482/27
6,223,673 B1 * 5/2001 Mears et al. ..... 482/27
6,261,207 B1 * 7/2001 Publicover et al. ..... 482/27

* cited by examiner

*Primary Examiner*—Glenn E. Richman
(74) *Attorney, Agent, or Firm*—Bacon & Thomas, PLLC

(57) ABSTRACT

The present invention relates to a protection device for a trampoline, wherein the protection device comprises a predetermined amount of support parts, the two ends of each support part being separately installed with an upper half part and a lower half part; and a protection film being installed between two support parts. Finally, the protection device is combined with a trampoline in order to ensure the safety of a person exercising on the trampoline.

13 Claims, 3 Drawing Sheets

PROTECTION DEVICE FOR TRAMPOLINE

BACKGROUND OF THE INVENTION

The present invention relates to a protection device for a trampoline wherein the protection device is combined with a trampoline in order to provide safety for a person exercising on the trampoline.

Under the trend where a person pays a lot of attention to his/her physical health, exercise machines are quite popular on the market and trampolines are often found in gymnasiums or stadiums. However, those trampolines are not equipped with any protection device.

Trampolines are common exercise equipment. However, since a trampoline per se is not equipped with any protection measures, a user is often suffered from injuries caused by falling off the trampoline. Therefore, in the past, a spongy pad is often placed on the periphery of the trampoline to prevent a user from being injured when the user falls off the trampoline. The material of the spongy pad is, however, often liable to degrade due to use and aging and loses its original elasticity and, as a result, causes injuries to a user. Furthermore, a spongy pad is sometimes misplaced by a user when the user falls off a trampoline such that a subsequent user is injured when he/she falls off the trampoline and is not landed on the spongy pad.

SUMMARY OF THE INVENTION

Based on the above disclosure, an ordinary trampoline is not equipped with a protection device and, therefore, often causes unnecessary injuries to a user. Therefore, the inventor of the present invention performs researches on this problem and develops a trampoline that has not only exercise functions, but also safety features.

The main objective of the present invention is to solve the above-mentioned drawbacks and avoid the existence of such drawbacks by combining a protection device with a trampoline thereby providing protection for a user exercising on the trampoline.

Detailed explanation and technical contents of the present invention are disclosed hereinafter, together with the figures.

DETAILED DESCRIPTION OF THE PREFERRED EMBODIMENT

Figure 1:
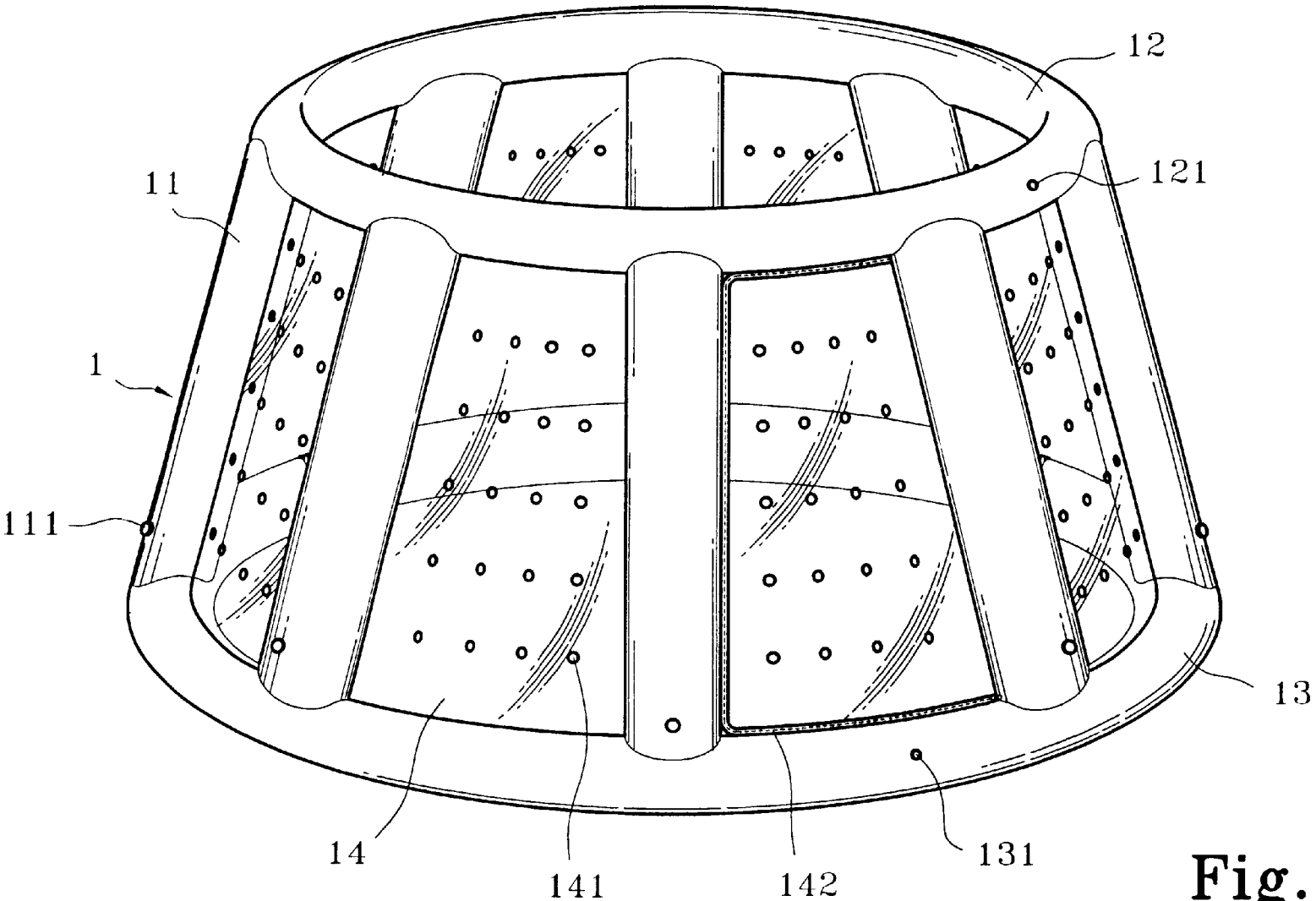
FIG. 1: A 3-D schematic diagram of the present invention.

FIG. 1 shows a 3-D schematic diagram of the present invention. As shown in FIG. 1, the protection device 1 comprises a predetermined quantity of support parts 11, the two ends of each support part 11 being separately installed with an annular upper half part 12 and an annular lower half part 13; and a protection film 14 being installed between two support parts 11. wherein, each of the support part 11, the upper half part 12 and the lower half part 13 are gas-filled bodies. wherein, the upper half part 12 and the lower half part 13 are multilateral bodies. wherein, each of the support part 11, the upper half part 12 and the lower half part 13 are installed with gas-filling openings 111, 121 and 131. wherein, the protection film 14 between two support parts 11 is installed with a plurality of air permeable openings 141; furthermore, one face of the protection film 14 is openable, and the periphery of the openable protection film 14 is installed with an opening and closing element 142. wherein, the opening and closing element 142 is a slide fastener assembly or a button assembly. wherein, the protection film 14 is made of a transparent material or a non-transparent material. wherein, each of the support part 11, the upper half part 12 and the lower half part 13 can form an interconnected state and be inflated through a gas-filling opening.

Figure 2:
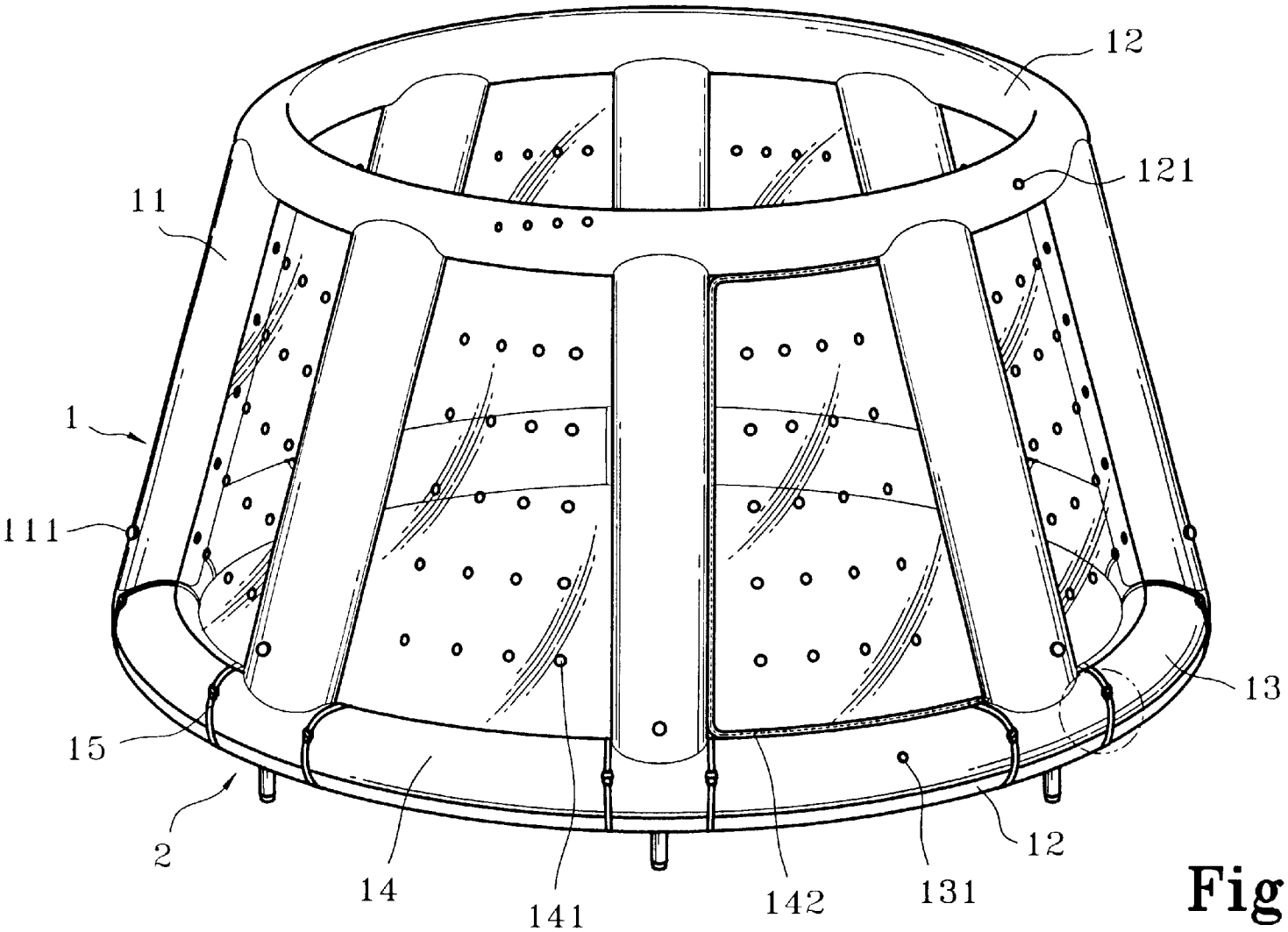
FIG. 2: A schematic diagram for the present invention under use.
Figure 3:
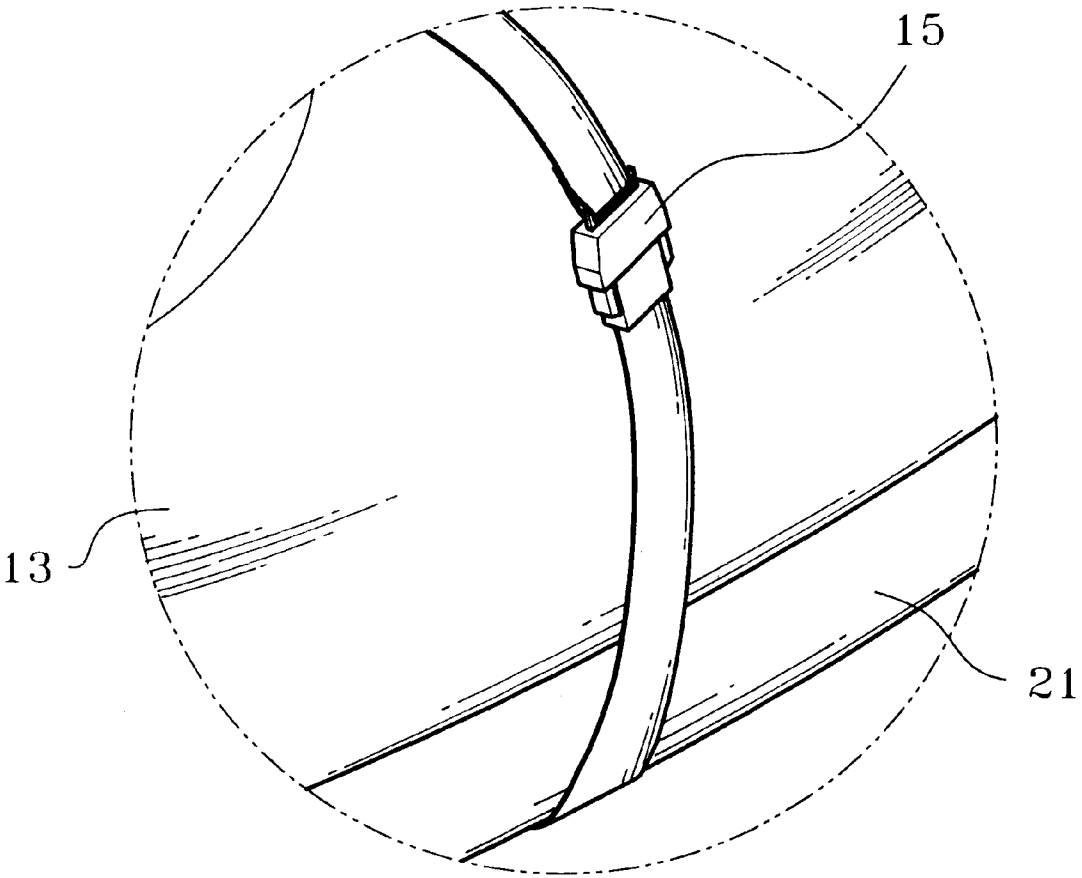
FIG. 3: A schematic diagram for an assembly of the present invention and a trampoline.

FIG. 2 and FIG. 3 are a schematic diagram for the present invention under use and a schematic diagram of an assembly of the present invention and a trampoline, respectively. As shown in the figures, the protection device 1 is combined with a trampoline 2 by buckling the lower half part 13 with the frame 21 of a trampoline 2 through a predetermined amount of fastening elements 15 to form a trampoline equipped with a protection device 1. wherein, the fastening element 15 is a Velcro or a male-female buckling element.

Therefore, the present invention combines a protection device with a trampoline to provide safety to a user exercising on the trampoline such that the user can exercise on the trampoline in a safe environment and prevent himself/herself from being injured caused by falling off the trampoline. The present invention completely eliminates the conventional drawbacks and endows a trampoline, in addition to exercise functions, with safety features. However, the above-mentioned disclosure is only a preferred embodiment of the present invention, and is not used to limit the scope of the present invention. Any equivalent modification or alteration of the claims of the present invention is within the scope of the present invention.

What is claimed is:

1. A protection device for a trampoline comprising: a predetermined amount of support parts, the two ends of each support part being separately installed with an upper half part and a lower half part, and a protection film being installed between two support parts, wherein one face of the protection film is openable, and the periphery of the openable protection film is installed with an opening and closing element, thereby forming the protection device.

2. The protection device for a trampoline as claimed in claim 1, wherein each of the support part, the upper half part and the lower half part are gas-filled bodies.

3. The protection device for a trampoline as claimed in claim 1, wherein each of the support part, the upper half part and the lower half part are installed with gas-filling openings at appropriate positions, or each of the support part, the upper half part and the lower half part form an interconnected state and are inflated through a gas-filling opening.

4. The protection device for a trampoline as claimed in claim 1, wherein the protection film between the support parts is installed with a plurality of air permeable openings.

5. The protection device for a trampoline as claimed in claim 1, wherein the upper half part and the lower half part are annular bodies.

6. The protection device for a trampoline as claimed in claim 1, wherein the upper half part and the lower half part are multilateral bodies.

7. The protection device for a trampoline as claimed in claim 1, wherein the protection film is made of a transparent material.

8. The protection device for a trampoline as claimed in claim 1, wherein the protection film is made of a non-transparent material.

9. The protection device for a trampoline as claimed in claim 1, wherein the opening and closing element is a slide fastener assembly.

10. The protection device for a trampoline as claimed in claim 1, wherein the opening and closing element is a button assembly.

11. A protection device for a trampoline a lower part of the protection device is combined a frame mounted with the trampoline through a plurality of fastening elements.

12. The protection device for a trampoline as claimed in claim 11, wherein the fastening element is a Velcro.

13. The protection device for a trampoline as claimed in claim 11, wherein the fastening element is a male-female buckling element.

* * * * *